US007309082B1

(12) United States Patent
Edwards

(10) Patent No.: US 7,309,082 B1
(45) Date of Patent: Dec. 18, 2007

(54) DOCUMENT SHEET WITH RECESSED CAVITY AND WINDOW TO ALLOW TWO-SIDED PRINTING OF AN OBJECT RECEIVED THEREIN

(76) Inventor: Paul R. Edwards, 235 Green Briar Estates Dr., St. Louis, MO (US) 63122

( * ) Notice: Subject to any disclaimer, the term of this patent is extended or adjusted under 35 U.S.C. 154(b) by 415 days.

(21) Appl. No.: 10/851,801

(22) Filed: May 21, 2004

Related U.S. Application Data

(60) Provisional application No. 60/472,551, filed on May 22, 2003.

(51) Int. Cl.
*G09F 3/00* (2006.01)

(52) U.S. Cl. ..... 283/101; 428/40.1; 428/221

(58) Field of Classification Search ..... 283/81, 283/101, 103, 105; 428/40, 221, 40.1, 41.8
See application file for complete search history.

(56) References Cited

U.S. PATENT DOCUMENTS

| | | | | |
|---|---|---|---|---|
| 2,780,572 | A | 2/1957 | Carlson | |
| 2,977,017 | A * | 3/1961 | Herzig | 156/108 |
| 3,212,412 | A * | 10/1965 | Langan et al. | 425/302.1 |
| 3,322,441 | A * | 5/1967 | Eichorn | 281/5 |
| 3,668,980 | A * | 6/1972 | Tone | 493/326 |
| 4,277,089 | A | 7/1981 | Lockhart | |
| 4,379,573 | A | 4/1983 | Lomeli et al. | |
| 4,447,481 | A | 5/1984 | Holmberg | |
| 4,551,374 | A | 11/1985 | Holmberg | |
| 4,799,712 | A | 1/1989 | Biava et al. | |
| 4,890,862 | A | 1/1990 | Buchholz | |
| 5,096,229 | A | 3/1992 | Carlson | |
| 5,131,686 | A | 7/1992 | Carlson | |
| 5,320,387 | A | 6/1994 | Carlson | |
| D352,310 | S | 11/1994 | Edwards | |
| 5,413,830 | A * | 5/1995 | Edwards | 428/42.1 |
| D361,593 | S | 8/1995 | Edwards | |
| 5,439,255 | A * | 8/1995 | McIntire et al. | 283/62 |
| 5,466,013 | A | 11/1995 | Garrison | |
| 5,522,956 | A * | 6/1996 | McCannel | 156/209 |
| 5,756,175 | A * | 5/1998 | Washburn | 428/42.3 |
| 6,409,871 | B1 * | 6/2002 | Washburn et al. | 156/256 |
| 6,569,280 | B1 * | 5/2003 | Mehta et al. | 156/275.5 |
| 6,743,493 | B2 * | 6/2004 | Crum et al. | 428/42.2 |
| 6,749,230 | B1 * | 6/2004 | Casagrande | 283/61 |
| 2005/0019538 | A1 * | 1/2005 | Edwards | 428/221 |

FOREIGN PATENT DOCUMENTS

WO WO 01/26892 A1 4/2001

* cited by examiner

*Primary Examiner*—Erica Cadugan
(74) *Attorney, Agent, or Firm*—Lewis, Rice & Fingersh, L.C.

(57) ABSTRACT

A document sheet with a removably attached object thereon having simplified inexpensive construction and having a reduced cross-sectional thickness enabling use of the sheet in printers without the risk of jamming the printer. The document sheet also allows both sides of the object to be printed prior to its removal from the sheet with preferably at least 60% of the rear surface being accessible for printing through the use of an indentation window.

4 Claims, 4 Drawing Sheets

DOCUMENT SHEET WITH RECESSED CAVITY AND WINDOW TO ALLOW TWO-SIDED PRINTING OF AN OBJECT RECEIVED THEREIN

CROSS REFERENCE TO RELATED APPLICATION(S)

This application claims priority to U.S. Provisional Application Ser. No. 60/472,551, filed May 22, 2003, the entire disclosure of which is herein incorporated by reference.

BACKGROUND OF THE INVENTION (1) Field of the Invention

The present invention pertains to a document sheet or a business form that is formed as a single sheet or part of a continuous web of interconnected sheets, where an indentation(s) are debossed into a front surface of the sheet and an object, such as a card, label, or coin, is releasably adhered to the sheet in the indentation. The indentation being in the shape of a frame with the periphery of the object connected to the indentation so as to enable the printing of both sides of both the document sheet and object.

(2) Background of the Invention

It is well known in the prior art to provide document sheets and business forms with removable labels and cards adhered to the sheets and forms. The various different types of sheets and forms with adhered cards range from business forms with removable, adhesive-free data cards secured to the front surface of the forms such as that disclosed in the U.S. Pat. No. 4,890,862, to business forms with removable, self-stick labels fabricated within the thickness of the forms as disclosed in U.S. Pat. No. 4,379,573.

Prior art document sheets and business forms of the type having data cards adhered to their front surfaces have been found to be disadvantaged in that the projecting height or thickness of the data card from the front surface of the sheet will, at times, cause the sheet to jam in a printing apparatus. Business forms and document sheets of the type where a self-adhesive label is fabricated within the thickness of the sheet often require the addition of an underlayment beneath the self-stick label. The cost of the underlayment and its attachment to the underside of the label and sheet contribute significantly to the overall cost of the document sheet. Further, because of the underlying support section, it is not generally possible to print on the rear of the label because the supporting sheet is in the way.

Other business forms have tried to accommodate two sided printing through the use of windows that are cut through the material of the supporting sheet (whether as an underlayment or the main document sheet) so as to allow printing of both sides. The problems with these windows has been that generally they only allow a small printable area of the rear to be printed while the entire front can be printed. In particular, those forms which have windows only allow about 50% of the back area to be printed with only about 65% of any given dimension available. While this is acceptable for many applications, it is regularly insufficient as the area is centered in the back of the card and the surrounding white space can make the printed area appear odd. Further, there is by necessity, a lot of unused space which cannot be printed. Further, those forms attempting to increase printable area on the back regularly have to use tape or other underlying support, again increasing the risk of jam.

SUMMARY OF THE INVENTION

The document sheet described herein provides a document sheet with a removably attached object thereon having simplified inexpensive construction and having a reduced cross-sectional thickness enabling use of the sheet in printers without the risk of jamming the printer. The document sheet also allows both sides of the object to be printed prior to its removal from the sheet with preferably at least 60% of the rear surface being accessible for printing through the use of an indentation window.

The document sheet of the present invention is basically comprised of a sheet of material, preferably paper stock, having an indentation area in the shape of a frame recessed in its front surface and an object secured in a portion of the indentation area such that both the front and back sides of the object may be printed without having to remove the object from the indentation.

In variant embodiments, the document sheet is provided as a single sheet, and as a sheet of a continuous web of sheets wherein each individual sheet is separated by a transverse frangible line such as a perforation line. The individual sheets of the continuous web of sheets may also be provided with left and right side margins separated from the document sheets by frangible lines such as perforation lines and having pluralities of tractor holes provided therein as a conventional continuous web of computer printer paper.

The indentation(s) in the front surface of the sheet may be formed by depressing, debossing, or otherwise moving the material of the sheet from the front surface back into the thickness of the sheet. The configuration of the indentation area may vary to complement the configuration of an object to be adhered to the sheet in the indentation. The depth of the penetration of the indention area into the document sheet and the thickness of the object to be adhered to the sheet in the indentation area may vary depending on the thickness of the stock material employed in constructing the sheet.

The object is generally adhered within the indentation area on the indentation surface of the sheet. Preferably, the object is releasably adhered in the indentation area to permit its easy removal from the sheet. The thickness of the object is preferably at least as large as the distance of the indentation area into the sheet thickness from the sheet top surface. This is to enable the front surface of the document sheet, the front surface of the object, the rear surface of the document sheet, and the rear surface of the object to be printed when running the document sheet through a printer. This printing may occur simultaneously, sequentially (duplex), or in any other fashion. Alternatively, an object having a greater thickness than the distance of penetration of the indentation area into the thickness of the document sheet may be employed.

With the object being adhered to the indentation surface, a portion of the object's thickness is recessed into the indentation depth so that only a fraction of the object's thickness projects above the front surface of the sheet. This reduces the projection of the object from the front surface of the sheet and lessens the risk of the sheet and object jamming a conventional printer than heretofore has been available with prior art document sheets having cards affixed to their front surfaces. By forming the indentation area in the sheet front surface by debossing the material of the sheet, the document sheet of the invention may be produced more economically than prior art document sheets and business forms comprising underlayment layers beneath cards or labels cut into the thickness of the document sheet.

Further, the arrangement of the indentation area to include a hole, window, or similar cut-out through the indentation surface, allows access to a portion of the surface of the object that is adjacent the sheet. In this way, both sides of the object may be printed without having to remove the object from the sheet. This allows for more economical printing as the object does not need to be detached and reattached to print both sides, both sides of the object may be printed, and the object may be printed on both sides using standard duplex or other two-sided printing techniques.

There is described herein, in an embodiment, a document sheet comprising: a sheet of paper material having a front surface and a back surface and having a peripheral edge and a first thickness between the front and back surfaces; an indentation area formed by recessing back the sheet front surface, the indentation having an indentation surface recessed a first distance into the sheet thickness from the front surface; a first indentation window comprising a hole through a portion of the indentation area, the first indentation window being entirely within the indentation area; and a first object having a first surface and a second surface and a second thickness that is at least equal to the first distance, the first object being received within the indentation area and the second surface of the first object being removably secured to the indentation surface about a periphery of the second surface of the first object; wherein the first indentation window allows access to a portion of the second surface of the first object, the portion being at least 60% of the area of the second surface of the first object.

In an embodiment of the document sheet at least 70% of one dimension of the second surface of the first object can be accessed via the first indentation window.

In another embodiment of the document sheet, the document sheet further includes a second indentation window, the second indentation window also being entirely within the indentation area and separate from the first indentation window; a second object, the second object also having a first surface and a second surface and having a third thickness, the second object being received within the indentation area and the second surface of the second object being removably secured to the indentation surface about the periphery of the second object; wherein the second indentation window allows access to a portion of the second surface of the second object, the portion of the second surface of the second object being at least 60% of the area of the second surface of the second object.

In another embodiment of the document sheet at least 70% of one dimension of the second surface of the second object can be accessed via the second indentation window.

DETAILED DESCRIPTION OF THE PREFERRED EMBODIMENTS

Figure 1:
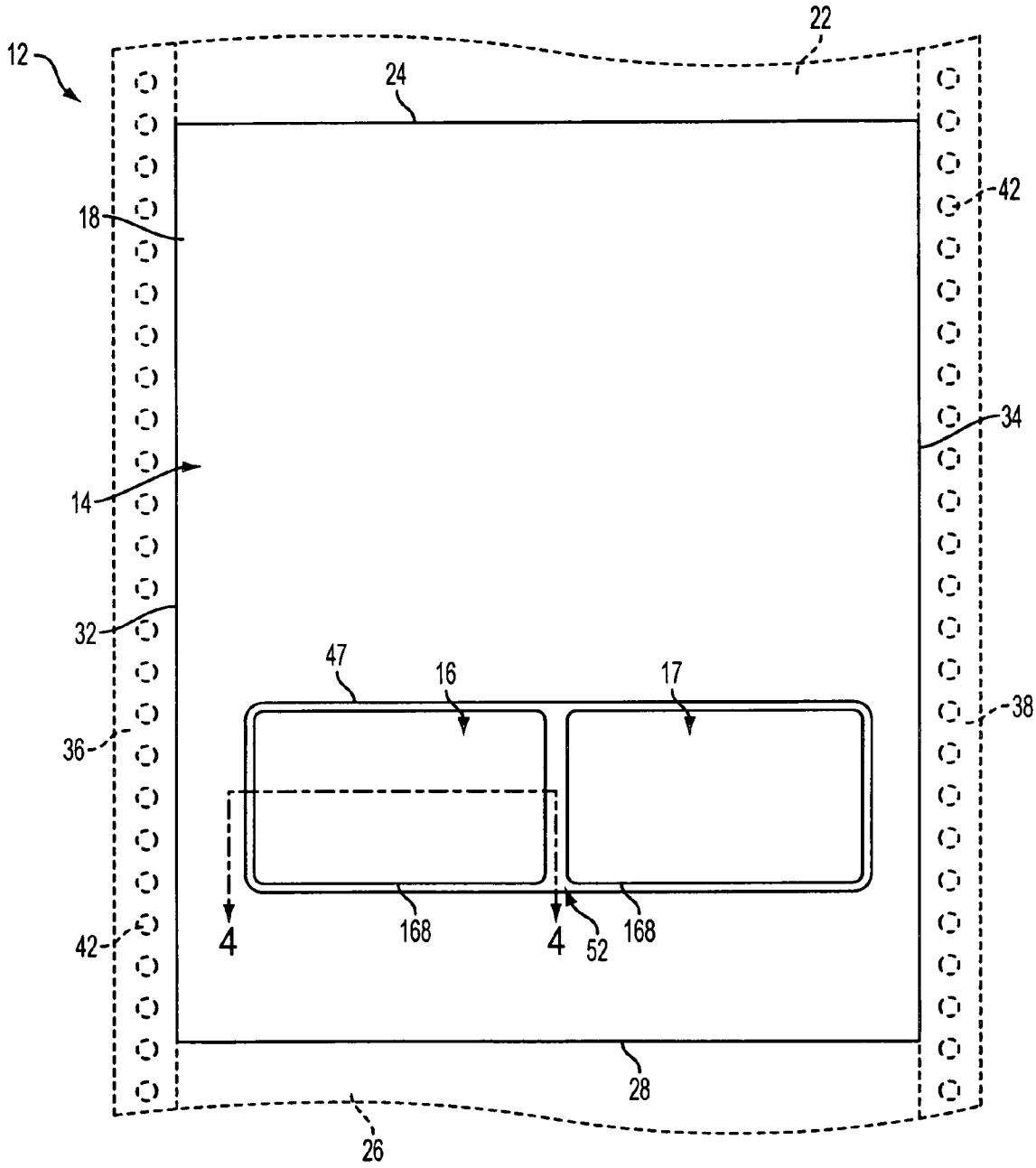
FIG. 1 is a view of the front surface of a first embodiment of a document sheet and two affixed objects.

FIGS. 1 through 4 show different views of an embodiment of a document sheet (12) constructed in accordance with a method so as to provide at least 60% of the back of the object to be available for printing. The document sheet (12) of this embodiment is basically comprised of a sheet of material (14) and two objects (16) and (17) adhered to the front surface (18) of the sheet. While two objects (16) and (17) are shown in this embodiment, one of ordinary skill in the art would understand that one or more objects may be included in different embodiments of the invention. The sheet of material (14) is shown in solid lines in FIG. 1 as a single sheet. However, in variant embodiments of the invention, the sheet of material (14) may be one of a continuous web of material sheets with a second (22) and additional like sheets connected along a top peripheral edge (24) of the sheet and a third (26) and additional like sheets connected along a bottom peripheral edge (28) of the sheet.

Figure 2:
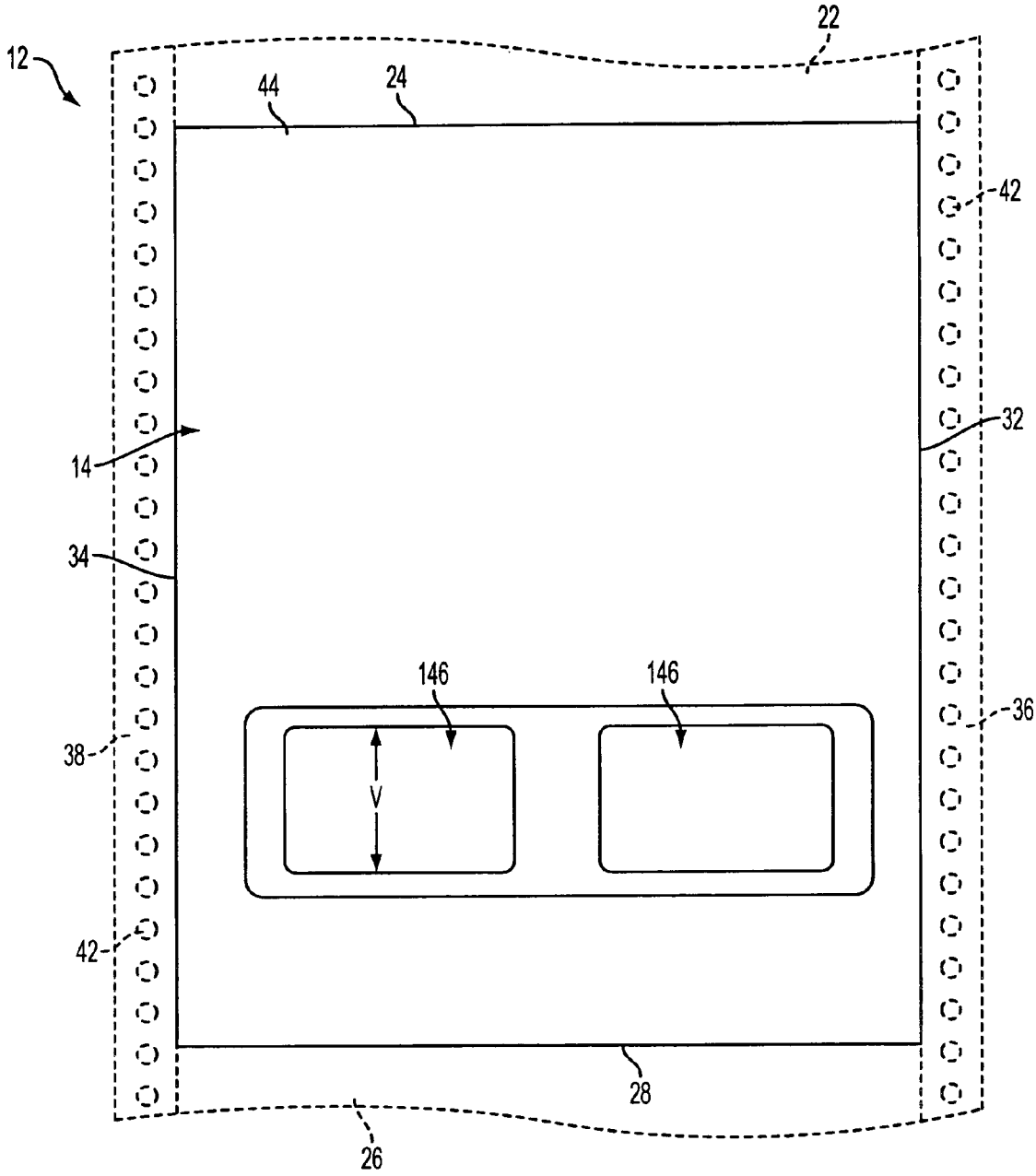
FIG. 2 is a view of the rear surface of the embodiment of FIG. 1.
Figure 3:
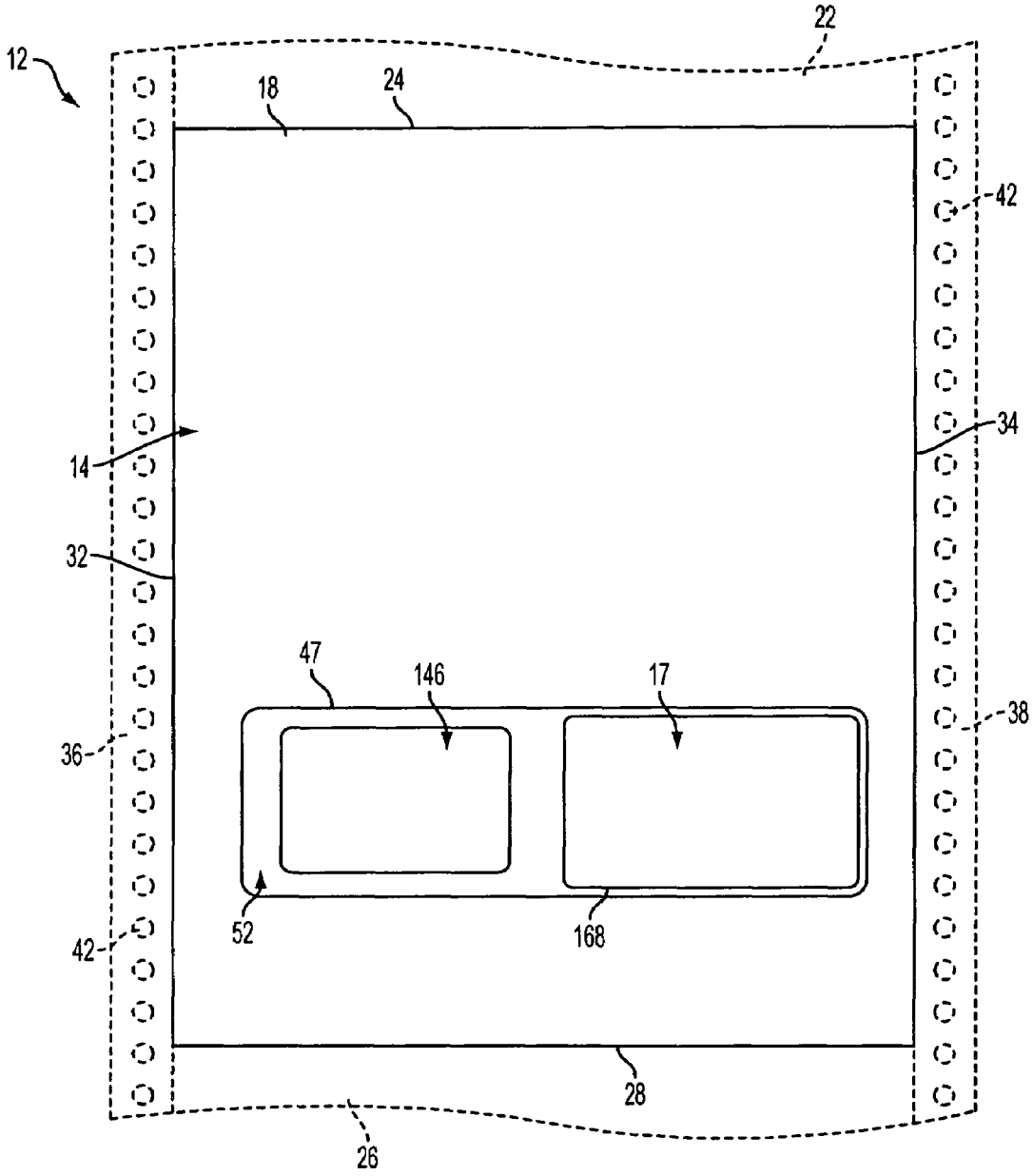
FIG. 3 is a view of the front surface of the embodiment of FIG. 1 with one of the two objects removed to show the window.

An embodiment of the sheet (12) in which it is one sheet or portion of a continuous web is represented in dashed lines in FIGS. 1-3. The top peripheral edge (24) connecting the sheet (12) to the second sheet (22) may be a frangible edge such as a fold line or a line of perforations that facilitate the separation of the two sheets along the line. Likewise, the bottom peripheral edge (28) of the sheet may provide a frangible connection between the sheet (12) and the third sheet (26) with the frangible connection being provided by a fold line or a line of perforations. In a still further variant embodiment of the invention, the left (32) and right (34) peripheral edges of the document sheets may be frangible connections to left (36) and right (38) margins. These peripheral edges may include tractor holes (42) provided therethrough as in computer printer paper or may simply provide for an edge. Although not shown, in variant embodiments the sheet (12) may also be provided with fold lines or tear lines within the peripheral edges (24), (28), (32), (34) of the sheet (12). The material of the sheet (14) is preferably paper stock and the thickness of the sheet (12) between the front surface (18) and back surface (44) of the sheet (12) may vary depending on the particular application desired for the document sheet.

An indentation area (47) is provided in the front surface (18) of the sheet (12). As shown in FIGS. 1 through 4, the indentation (47) has a generally rectangular configuration conforming to the rectangular configuration of the objects (16) and (17) in combination. However, the configuration of the indentation area (47) may take on a variety of shapes complementary to the configuration of a particular object(s) (16) and (17) to be secured to the front surface (18) of the sheet (12). For example, if a singular object (16) was provided which was round, the indentation area (47) would also be generally round.

The indentation area (47), in an embodiment, may include an access tab (not shown) as described in U.S. patent application Ser. No. 60/470,279, the entire disclosure of which is herein incorporated by reference.

At the back of the indentation area (47) (referring to the direction downward in FIG. 4 or into the page of FIG. 1) is an indentation surface (52) of the sheet recessed below the sheet front surface (18) and into the thickness of the sheet (12) by a desired distance, the distance being dependent on the thickness of the sheet material and the thickness of the object (16) to be adhered to the sheet front surface (18). Generally, the indentation area (47) is formed into the thickness of the sheet (12) by recessing the material of the sheet (12), for example by using a debossing die, rotary press, or letter press. The indentation surface (52) has an indentation window (146) cut therethrough so as to make the indentation area (47) be defined by the indentation surface (52) (which is generally the peripheral area) and a hole (the indentation window (146)) therethrough.

Figure 4:
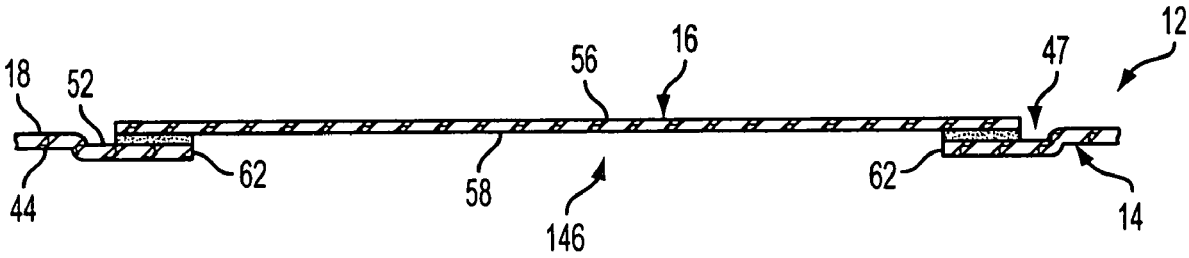
FIG. 4 is a cross-sectional view of part of FIG. 1 along the line 4-4.

As should be apparent from FIG. 4, forming the indentation area (47) may be completed by compressing the front surface (18) toward the back surface (44) decreasing the thickness of the sheet (12) in the indentation area (47). Alternatively or additionally, the front surface (18) and back surface (44) of the sheet (12) may be transposed backwards in the indentation area (47) moving the portion of the sheet (12) in the indentation area (47) backwards relative to the rest of the sheet (12). Either of these two process, alone or in combination, would serve to form an indentation area (47) in the sheet (12) whereby the indentation surface (52) is recessed from the front surface (18) by a distance. One of ordinary skill in the art would further recognize that while this description refers to the indentation area (47) being recessed backwards relative to the front surface (18) of the sheet (12), the sheet (12) could alternatively be formed by recessing the sheet which is not in the indentation area (47) forwards. For simplicity, all of these forming methods, and others which would be understood by one of ordinary skill in the art, will be referred to as forming or recessing an indentation in the front surface (18) of the sheet.

It can be seen in FIG. 4 that by forming the indentation area (47) into the thickness of the sheet (14), a projecting surface (54) is formed in the sheet back surface (44) projecting about the same distance from the back surface that the indentation surface (52) extends into the sheet thickness from the front surface (18), there being a slight difference in these distances due to compression of the sheet material forming the indentation surface (52).

The indentation area (47) provided in the front surface (18) of the sheet (12), as shown in FIGS. 1 through 4, comprises two portions. The first portion is an indentation surface (52) and the second portion is at least one indentation window (146). The indentation window (146) is a hole through the indentation surface (52) so that the indentation surface (52) is not continuous over the back surface (58) of the object (16) or the object (17). In particular, the indentation surface (52) is generally arranged so as to be of a generally frame shape suspending the outer perimeter (168) of the object (16) or (17) and extending slightly over the back surface (58) while still allowing access to the majority of the back surface (58). In a preferred embodiment, the indentation window (146) does not extend beyond the confines of the indentation area (47).

FIG. 4 shows a cross-sectional cut-through of the embodiment of FIG. 1, which best illustrates how one of the indention windows (146) is arranged. The first object (16) (which is the object cut through in FIG. 4) has a top surface (56) and a back surface (58), with the back surface (58) being adjacent the sheet (14). In order to attach the back surface (58) to the sheet (12), a portion of the back surface (58) is adhered to the indentation surface (52) which is preferably arranged so as to be a generally planar arrangement with a hole comprising the indentation window (146) therethrough. An adhesive (62) is preferably employed to secure the object back surface (58) to the indentation surface (52). The adhesive (62) may be applied to the object back surface (58) or the indentation surface (52) prior to the object (16) being received in the indentation area (47) and pressed against the indentation surface (52). The adhesive (62) may be a permanent adhesive, or preferably may be a releasable adhesive, enabling the object (16) to be easily removed from the indentation surface (52) and the document sheet (14) when so desired.

The adhesive (62) is however not spread on the portion of the back surface (58) which is not over the indentation surface (52) (the portion which is over the indentation window (146)). This portion is instead suspended in front of the window (146). Further since the window (146) comprises a hole or similar opening in the sheet (12), the portion of the back surface (58) of the object (16) or (17) can be accessed via the indentation window (146) from the sheet back surface (44). The adhesive (62) may be provided as a continuous layer or may be a non-continuous layer depending on the material used as adhesive (62) and the mechanisms or methods used to place it. The layer may be supplied as a pattern of dots, strips, or any other shape in an embodiment of the invention which may either maintain their individual shapes or may merge with each other to form a relatively continuous plane of material.

It can be seen in FIG. 4 that by forming the indentation area (47) into the front surface (18) of the sheet (12), the thickness or the projecting height that the objects (16) and (17) would project above the sheet front surface (18) is lessened by the distance that the indentation surface (52) is recessed into the thickness of the document as the objects (16) and (17) lay on the indentation surface (52). The distance that the objects (16) and (17) thickness would project above the sheet (12) front surface (18) if they were not received in the indentation area (47) is the distance that the projection surface (54) of the sheet (12) projects from the sheet back surface (44), less the change in sheet thickness due to compression of the sheet material when the indentation area (47) is formed. In this manner, the document sheet (12) of the present invention distributes the thickness of the objects (16) and (17) adhered to the sheet (12) between the front surface (18) and back surface (44) of the sheet (12) so that the objects (16) and (17) may be adhered to the sheet (12) while presenting a very small proturbance from the sheet (12) front surface (18) and back surface (44). Distributing the thickness of the objects (16) and (17) on the front (18) and back surfaces (44) of the sheet (12) enables the sheet (12) to provide an inexpensive document having attached objects (16) and (17), both sides of which can be printed by a conventional printer without as much risk of jamming the printer. As the two proturbances are preferably of similar amount, printing on either the front or the back of the objects generally will result in a similar likelihood of a jam.

In the illustrative example shown in the various FIGS., the objects (16) and (17) to be adhered to the sheet front surface (18) are rectangular identification cards. However, various different types of objects may be employed with the document sheet of the invention. For example, self-adhesive labels, coins, tokens, keys, and a variety of different types of objects may be adhered to the front surface of the sheet in the indentation area (47), the only requirement being that the objects (16) and (17) have a limited thickness.

The shape of the indentation window (146) may be of any shape, however, it will generally be preferred that the indentation window (146) be sized and shaped so as to allow at least 60% of the area of the back surface (58) to appear over the indentation window (146), while still insuring that the object is securely held within the indention area (47). For this reason, the shape of the indentation window (146) will preferably mirror the shape of the object (16) or (17) placed in front of that indentation window (146), but being slightly smaller. In this way the periphery of the object (16) or (17) is over the indentation surface (52) at all times and therefore the periphery is secured to the indentation area (47).

As it is intended that the indentation window (146) allow for printing of the back surface (58) of the object, the shape and size of the indentation window (146) is directly related to the printable area. With regards to rectangular identification cards, the amount of area of the back surface (58) of the card is a first consideration, secondly, however, is the way such identification cards are routinely printed. In printing a rectangular identification card, text is generally centered on the card in the horizontal direction to provide for an attractive balance. Further, due to the rolling of text onto a next line if it is too long for a single line, there is also generally a larger boundary formed than is strictly necessary. In the vertical direction (height) of the card, however, while printing is still generally centered, it is often extended much closer to the periphery of the card as this increases the number of lines of text which may be included on the card which is directly related to the information which may be carried by the card.

Because of the desire to maximize printable area, particularly in the vertical component (V in FIG. 2), it is preferable that at least 60% of the area of the back surface (52) of each object be accessible via the indentation window (146). Further, because of the way objects such as identification cards are printed (as discussed above), it is preferable that the in the vertical direction (V) at least 70% of the height of the back surface of each object (16) or (17) be accessible through the window. It is more preferable that at least 80% of the height of the back surface of each object be accessible.

An arrangement with increased available area as discussed above serves to deceive the human eye in determining the space that was actually available for printing. It looks as if the entire area was available for printing and to nicely center the printing, only a portion was actually used. In reality, that portion simply corresponds to the portion corresponds to the portion which was available resulting in the appearance of more available space than was actually available.

In window mounting documents of the prior art, such large window capacity was not obtained because the requirements of glue so as to align and place the object on the indentation surface meant that an indentation surface (152) covering less than 30% of the height of the object generally required additional additions of material such as tape strips or other underlayments attached to the sheet which led to an increased risk of jam. Further coverage of a greater percentage of the sheet was thought necessary to prevent separation. This separation would generally be caused due to the bending of the sheet (12) in many printing processes. In many modern printers, the sheet (12) to be printed is pulled from a tray and passes over at least two rotational connectors. One of these connectors will roll the sheet (12) forward, while the other rolls the sheet (12) backward. Further, this rolling will generally occur about a horizontal axis of the sheet (12) with the top (24) of the sheet (12) bent toward the bottom (28) of the sheet (12).

It is important to consider the effect of rolling an object (16) or (17) which is attached to a sheet (12) around another object. In particular, whichever piece (the sheet (12) or object (16) or (17)) is closer to the rotational axis will necessarily have a tighter angle of roll that the piece on the outside. When there are edges of the outside piece facing the direction of roll, these will generally stick up slightly due to this difference in angle. Further, the outside piece will generally want to move tangentially to the inside piece's motion and that will only be resisted by the strength of the bond between the two pieces.

In this rolling, if there is insufficient connection of the object (16) or (17) to the sheet (12), the rolling action (particularly where the rolling is backward) can cause the object (16) or (17) to separate from the indentation (47). This separation will cause the object (16) or (17) (no longer bound to the sheet (12) on the top edge) to generally stick outward from the rolled sheet (12) at a generally tangential direction. This will then either cause the object (16) or (17) to be caught by the printer and pulled completely from the sheet (12) resulting in a failure, or to have the sheet (12) and object (16) or (17) become jammed in the printer, also resulting in a failure. Even without separation, the leading edge of the object (16) or (17) will generally be made to stick out from the sheet (12) by the rolling (as discussed above) which can result in the increased height being caught on printing apparatus and jam.

When the sheet (12) rolls forward, a similar problem can occur, as the object (16) or (17) is bent around the rotation with the sheet (12) above it, if there is insufficient connection space, the edge of the indentation window (146) may become raised backward relative to the object (16) or (17). This raised portion can then also become caught on part of the printer. This problem does not exist on sheets (12) without an indentation window (146) as there is nothing to catch on the back side of the sheet (12).

The printing sheet (12) discussed above does not have the jamming problem other printing sheets can have with the increased available window. Because the indentation area (47) is recessed, during a backward roll the bend generally needs to be much tighter to allow the top edge of the object (16) or (17) to clear the indentation area (47) sufficiently to be snagged. With regards to a forward roll, this advantage generally does not exist and it was thought that a larger window would not be useable. However, it was discovered that a larger window can be used allowing access to more than 70% of the vertical dimension. Further, it was discovered that less space than previously thought necessary was needed to allow for glue application on the top and bottom of the indentation area (47) to prevent separation.

Although the document sheet and method are described above with reference to two objects (16) and (17) adhered in a single indentation area (47) of the sheet (14), it should be understood that any number of objects may be secured in one or more than one indentations in a variety of positions of both on the document sheet and relative to each other without departing from the sprit and scope of this invention. In example, in an embodiment, the sheet (12) may include a single object (16) in a single indentation area (47) or two objects (16) and (17) each in their own independent indentation areas (47).

While the invention has been disclosed in connection with certain preferred embodiments, this should not be taken as a limitation to all of the provided details. Modifications and variations of the described embodiments may be made without departing from the spirit and scope of the invention, and other embodiments should be understood to be encompassed in the present disclosure as would be understood by those of ordinary skill in the art.

The invention claimed is:

1. A document sheet comprising:

a sheet of paper material having a front surface and a back surface and having a peripheral edge and a first thickness between said front and back surfaces;

an indentation area formed by recessing back said sheet front surface, said indentation area having an indentation surface recessed a first distance into said sheet thickness from said front surface, wherein within said indentation area, both of said front surface and said back surface of said document sheet have been transposed backwards relative to other portions of the document sheet, thereby forming a projecting surface, which projects from the back surface of said sheet;

a first indentation window comprising a hole through a portion of said indentation area, said first indentation window being entirely within said indentation area; and a first object having a first surface and a second surface, each with an area larger than said indentation window, and a second thickness that is at least equal to the first distance, said first object being received within said indentation area on said recessed indentation surface and in covering relation to said indentation window so that said first object is suspended in front of said indentation window, said second surface of said first object being removably secured to said indentation surface about a periphery of said second surface of said first object;

wherein said first indentation window allows access to a portion of said second surface of said first object, said portion being at least 60% of the area of said second surface of said first object.

2. The document sheet of claim 1 wherein at least 70% of one dimension of said second surface of said first object can be accessed via said first indentation window.

3. The document sheet of claim 1 further comprising:

a second indentation window, said second indentation window also being entirely within said indentation area and separate from said first indentation window;

a second object, said second object also having a first surface and a second surface and having a third thickness, the second object being received within said indentation area and said second surface of said second object being removably secured to said indentation surface about the periphery of said second object;

wherein said second indentation window allows access to a portion of said second surface of said second object, said portion of said second surface of said second object being at least 60% of the area of said second surface of said second object.

4. The document sheet of claim 3 wherein at least 70% of one dimension of said second surface of said second object can be accessed via said second indentation window.

* * * * *